United States Patent [19]

Langas et al.

[11] Patent Number: 4,724,590

[45] Date of Patent: Feb. 16, 1988

[54] APPARATUS AND METHOD FOR AUTOMATICALLY SECURING BORDERWIRES ON MATTRESS INNERSPRINGS

[75] Inventors: Arthur Langas, Glenview; Donald B. Ayres, Skokie, both of Ill.

[73] Assignee: Hartco Company, Skokie, Ill.

[21] Appl. No.: 944,561

[22] Filed: Dec. 22, 1986

[51] Int. Cl.[4] ..... B68G 7/00

[52] U.S. Cl. ..... 29/91; 29/712; 140/93 D

[58] Field of Search ..... 29/91, 712, 173; 140/3 CA, 93 D; 267/110

[56] References Cited

U.S. PATENT DOCUMENTS

| | | | |
|---|---|---|---|
| 2,382,226 | 8/1945 | Hodges, Jr. | 29/91 |
| 2,716,308 | 8/1955 | Hodges, Jr. | 29/91 |
| 3,538,573 | 11/1970 | Ciampa et al. | 29/91 |

*Primary Examiner*—P. W. Echols

*Attorney, Agent, or Firm*—Wallenstein, Wagner, Hattis, Strampel & Aubel, Ltd.

[57] ABSTRACT

Apparatus for automatically securing borderwires on mattress innersprings, comprising support members for receiving borderwires and a mattress innerspring in stacked, properly oriented relation to one another. A drive mechanism is provided for automatically sequentially advancing the borderwires and the mattress innerspring along the support members to a clip wrapping station where a plurality of clips are simultaneously wrapped on the borderwires and the coils of the mattress innerspring. Control elements are provided for sensing when clips are to be wrapped, and when a predetermined number of clips have been wrapped on each side and each end of borderwires and the mattress innerspring.

30 Claims, 29 Drawing Figures

APPARATUS AND METHOD FOR AUTOMATICALLY SECURING BORDERWIRES ON MATTRESS INNERSPRINGS

TECHNICAL FIELD

The present invention relates to apparatus, and a method, for securing borderwires on mattress innersprings.

BACKGROUND OF THE PRIOR ART

In the manufacture of mattress innersprings, whether they are of the continuous coil or separate coil type, borderwires are secured to the coils along the entire upper and lower periphery of the innersprings to impart integrity and rigidity to the overall structure. Heretofore, the borderwires have been secured on the coils of mattress innersprings by means of a hand-held tool. Exemplary of a hand-held tool which can be used for this purpose is the tool disclosed in U.S. Pat. No. 4,546,528. As shown in the patent, the tool is provided with a pressurized air-actuated reciprocatable blade or plunger for sequentially severing clips from a line of interconnected clips spirally wound in the form of a roll. The tool includes an anvil or forming jaw for cradling the borderwire and the coils which form the mattress innerspring thereby enabling the severed clips to be wrapped on the borderwire and the coils of the innerspring by the blade or plunger. An experienced operator using such a tool can wrap clips on the borderwires and coils at the rate of about one clip per second. In an average day, such an operator can wrap upwards of 30,000 clips with the tool, while less skilled operators will average between 15,000 and 20,000 clips per day. Apart from the worker-fatigue problems encountered in a hand tool type operation for securing borderwires on mattress innersprings, the operator has the added burden of maintaining, with his free hand, the borderwires in proper alignment with relation to the coils of the innerspring while the hand tool which is being held in the other hand of the operator, is wrapping clips on the borderwires and the coils of the innerspring. This is a procedure which requires special training of the operator. It is especially difficult in those instances where the mattress innerspring is to be used for making largesized mattresses referred to in the trade as king and queen size.

BRIEF SUMMARY OF THE INVENTION

In accordance with the present invention, apparatus has been evolved for automatically securing borderwires on mattress innersprings. The apparatus is capable of increasing production rates by nearly fourfold over that of even the most skilled operator using a hand held tool. What is more, these significant increases in production rates are achieved with minimal labor, and without the need for special operator training. The apparatus is uncomplicated in design and construction to simplify its operation, and, more importantly, to reduce operating and maintenance costs to a minimum.

In brief, the apparatus of the present invention comprises horizontally disposed support means on which upper and lower borderwires and a mattress innerspring are positioned prior to the clip wrapping operation. Borderwire and mattress innerspring alignment means, which includes vertically movable stop means and horizontally movable pusher means, is associated with the support means. A plurality of clip wrapping tools advantageously is arranged in fixed, spaced relation to one another on each side of the support means for simultaneously wrapping a plurality of clips on the upper and lower borderwires and the coils of the mattress innerspring adjacent thereto as the mattress innerspring and the borderwires are advanced in unison along the support means by the horizontally movable pusher means of the alignment means. Coil sensing means is provided for transmitting a signal which activates the clip wrapping tools. Drive means, including a motor equipped with a brake and clutch, is provided for sequentially advancing the horizontally movable pusher means a predetermined distance after each clip wrapping operation of the clip wrapping tools. Borderwire spacer or separator means desirably is positioned adjacent to the support means to maintain the borderwires and the coils of the mattress innerspring in proper spaced relation to one another during a clip wrapping operation. Control means is provided for de-energizing the sensing means after a predetermined number of clips have been wrapped on the borderwires and the coils of the mattress innerspring along both sides of the mattress innerspring. The control means also acts to reverse the direction of the drive means whereby the borderwire and mattress innerspring alignment means is automatically returned to its original starting position ready for another clip wrapping operation.

The resulting structure, with the borderwires secured along either the length or the width of the mattress innerspring, is then shifted to a different position on the support means, and clips are wrapped on the unsecured sides of the borderwires and coils of the mattress innerspring in the manner described. In order to insure that the unsecured portions of the borderwires are properly oriented with relation to the coils of the mattress innerspring during this phase of the clip wrapping operation, reciprocatable coil engaging means is provided for exerting a laterally directed force on the coils to cause the coils to always be in a position to be engaged by the clip wrapping tools, and clips wrapped thereon in continuous aligned relation to the clips wrapped on the secured sides of the structure. Due to the curvature of the coils of the mattress innerspring at the corners thereof, the clip wrapping operation is completed by a secondary operation. The principal tasks required to be performed by the operator of the apparatus are to position the borderwires and a mattress innerspring on the support means at the start of the operation and to energize the control means. While the number of clip wrapping tools which can be used in carrying out a clip wrapping operation with the apparatus is variable, in a preferred embodiment of the present invention four clip wrapping tools are employed to secure the borderwires on the coils of a mattress innerspring. Utilizing this number of tools, four clips per second can be wrapped on the borderwires and the coils. The tools advantageously are positioned so that two clips are wrapped on each side, or each end, of the mattress innerspring during each cycle, thereby securing the upper and lower borderwires to the coils simultaneously as the borderwires and mattress innerspring are sequentially advanced along the support means in the direction of the clip wrapping tools. The control means may comprise a computer, or a system of relays, or the like, electrical signal generating means.

DETAILED DESCRIPTION OF THE INVENTION

Figures 1, 1A:
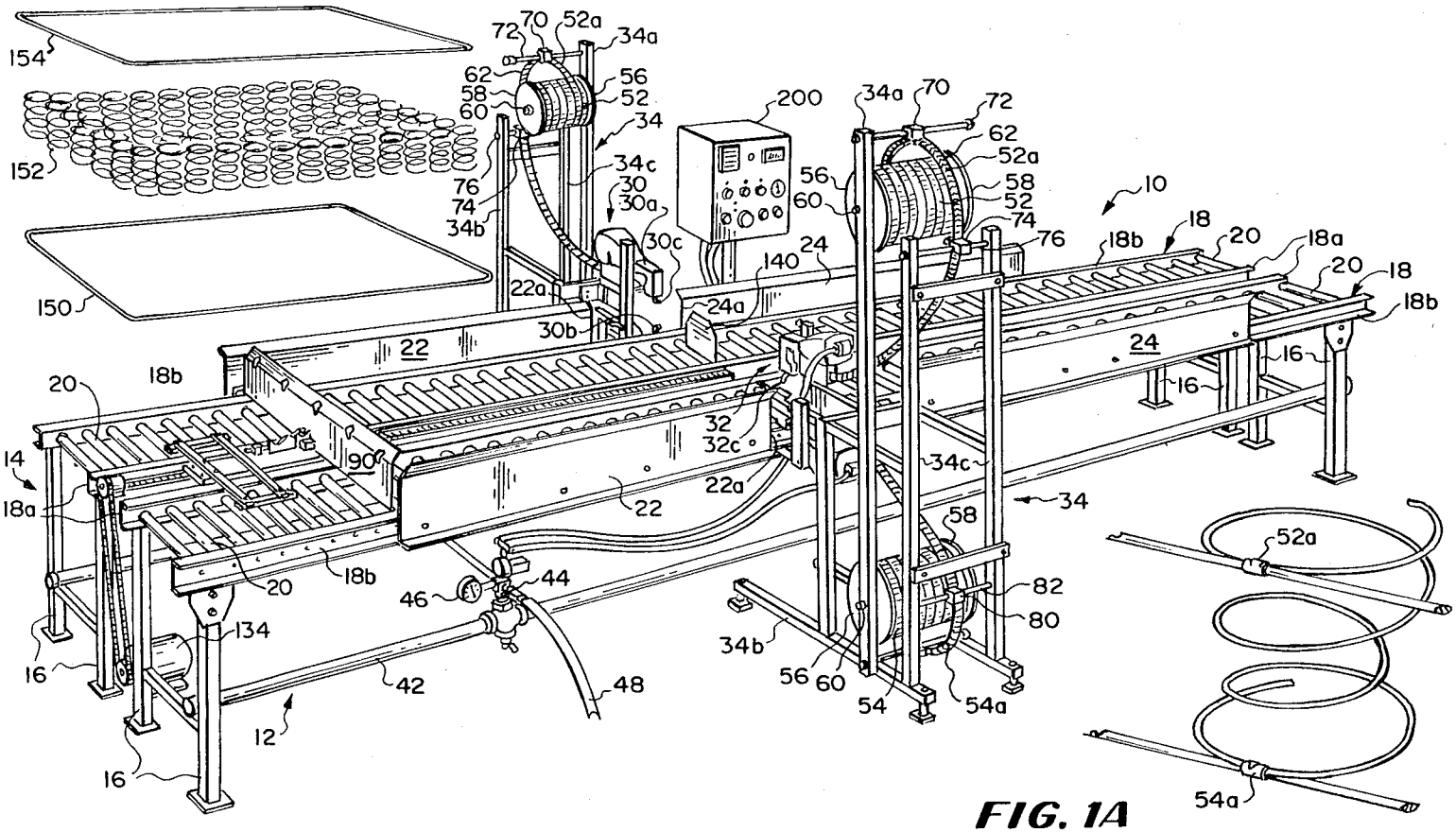
FIG. 1 is a view in perspective of an embodiment of the apparatus of the present invention, and shows in exploded form the relationship of the borderwires and a mattress innerspring when placed on the support means of the apparatus.
FIG. 1*a* is an enlarged fragmentary view in perspective showing clips as wrapped on a coil of a mattress innerspring with the apparatus of this invention.
Figure 2:
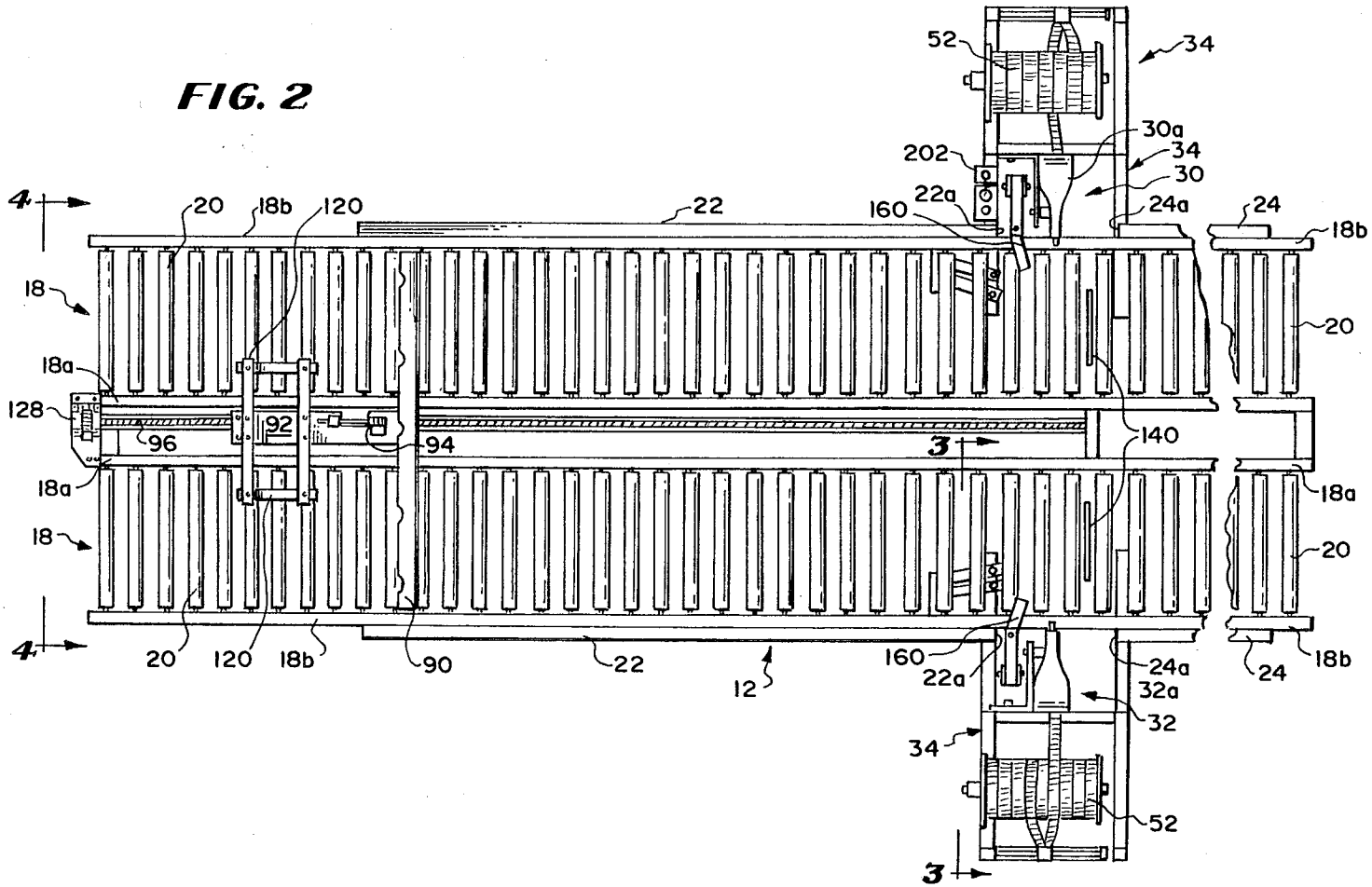
FIG. 2 is a top plan view of the apparatus shown in FIG. 1.
Figure 3:
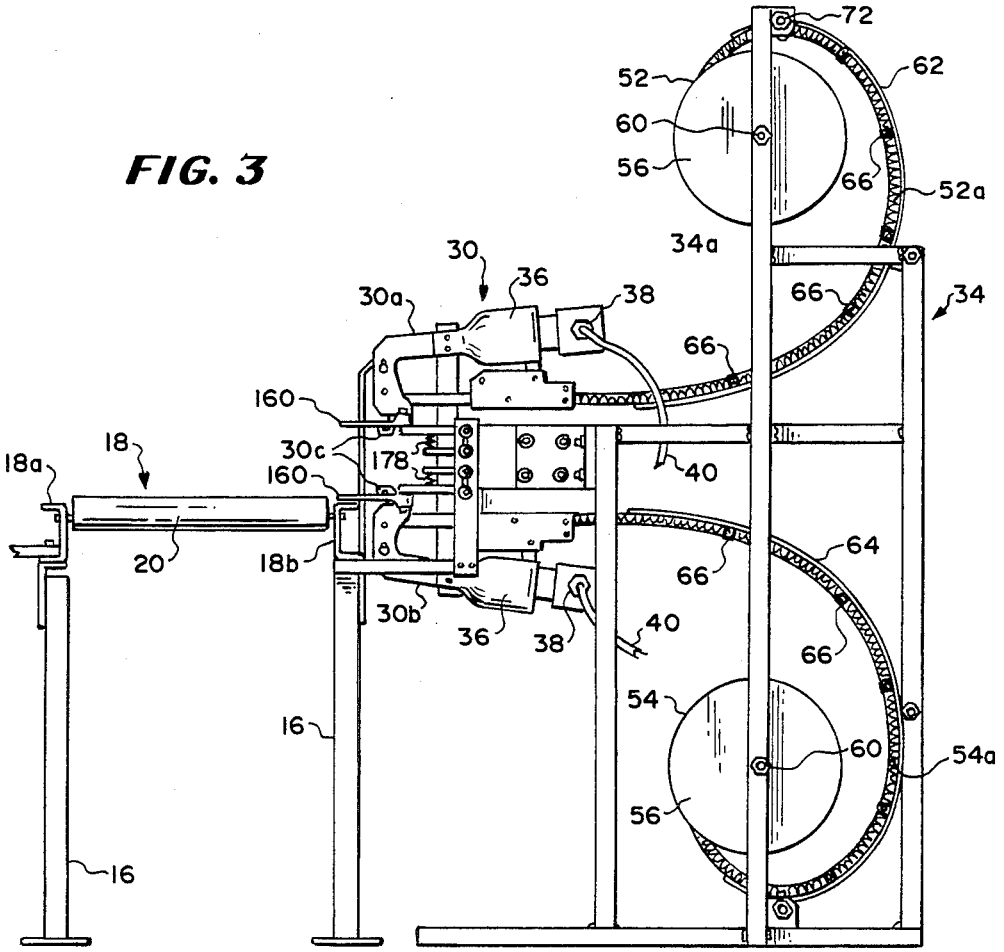
FIG. 3 is a fragmentary side view in elevation taken substantially along line 3—3 of FIG. 2.
Figure 19:
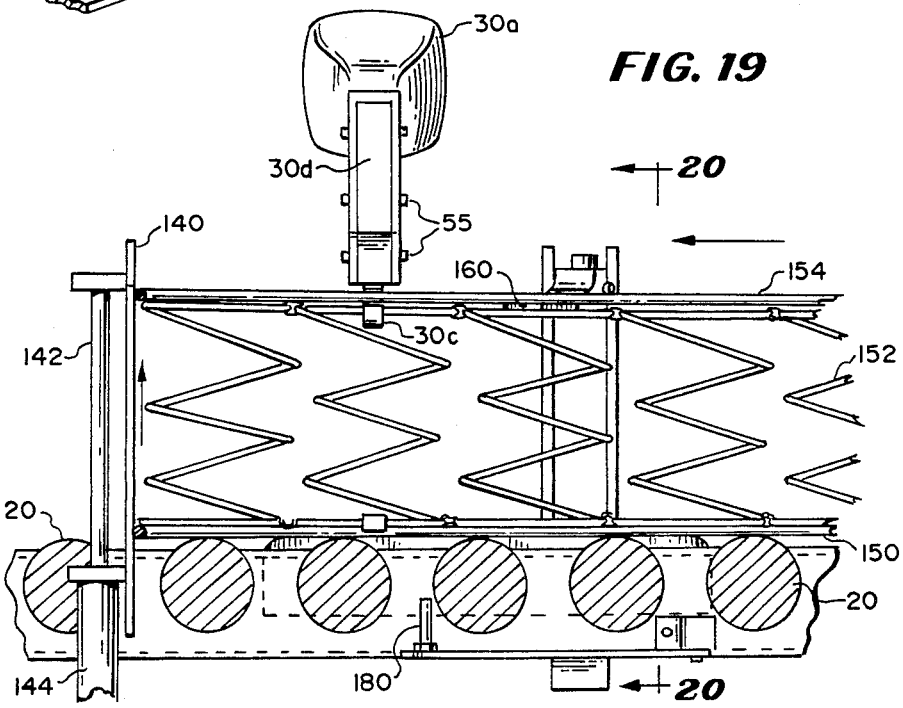
FIG. 19 is a fragmentary side view, partly in section, showing a clip being wrapped and the position of the upper borderwire spacer means during wrapping of the clip.
Figure 20:
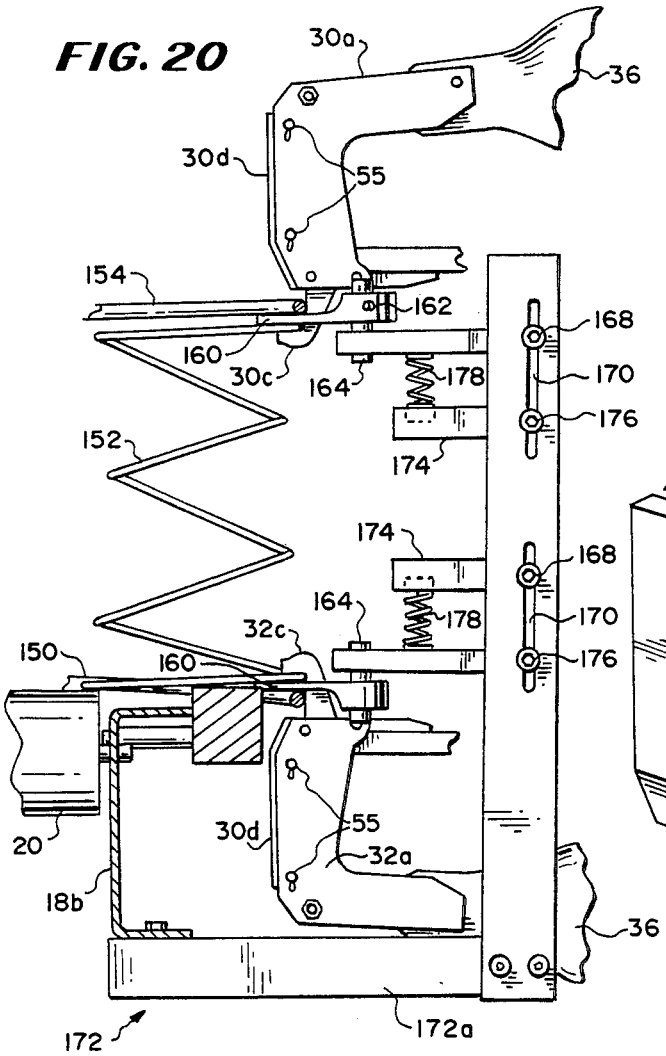
FIG. 20 is a fragmentary view taken substantially along line 20—20 of FIG. 19.
Figure 21:
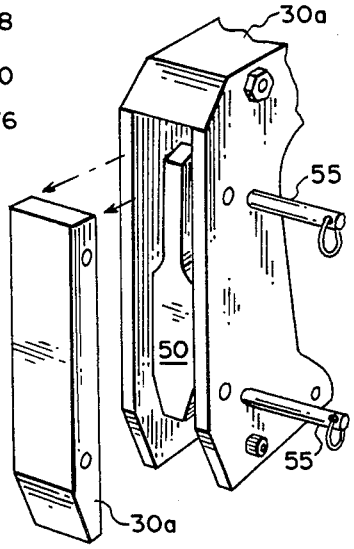
FIG. 21 is a fragmentary exploded view in perspective of the removable front plate on the clip wrapping tools comprising the apparatus.

Referring, in particular, to FIGS. 1 and 2 of the drawings, a portion, designated generally by reference numeral 10, of an embodiment of the apparatus of the present invention is shown as comprising support means 12 in the form of a metal frame 14 having legs 16 at the ends thereof. Two rows of horizontally disposed conveyor sections 18—18 are arranged in spaced, side-by-side relation on the frame 14, and extend along substantially the entire length of the frame 14. Each of the conveyor sections 18—18 comprises a plurality of horizontally spaced, freely rotatable rollers 20 journaled for rotation between laterally spaced inner channel members 18*a*—18*a* and outer channel members 18*b*—18*b*. As illustrated, two pairs of guide panels or walls 22—22 and 24—24 are positioned in opposed relation to one another on the frame 14, one of each pair of the panels or walls 22—22 and 24—24 being secured to the outer channel members 18*b*—18*b* of the conveyor sections 18—18. The inner ends 22*a*—22*a* and 24*a*—24*a* of the guide panels or walls 22—22 and 24—24 are spaced to accommodate two pairs of clip wrapping tools 30 and 32 carried in vertically spaced relation to one another on upright frames 34—34 positioned on opposite sides of the support means 12 adjacent to the outer channel members 18*b*—18*b* of the conveyor sections 18—18. Each pair of clip wrapping tools includes an upper tool 30*a* and 32*a* and a lower tool 30*b* and 32*b*, respectively. The clip wrapping tools are of a type similar to the clip wrapping tool disclosed in U.S. Pat. No. 4,546,528, and, as best shown in FIG. 3, comprise a housing 36 to which is secured a coupling 38 for attaching a flexible air hose 40 connected to an intermediate source 42 (see FIG. 1) of pressured air. The intermediate source 42, as shown, desirably comprises an elongated pipe provided with suitable air pressure regulating means including a valve 44 provided with a gauge 46. In the embodiment illustrated, the valve 44 is connected to the intermediate source 42 of pressurized air, while the source 42 is connected by means of hose 48 to a main source (not shown) of pressurized air. The clip wrapping tools are activated by the valve 44. Each of the tools is provided with a piston which drives a reciprocatable blade or plunger 50 (see FIG. 21) for sequentially severing each clip from lines of interconnected clips 52*a* and 54*a* spirally wound on upper clip feed rolls 52—52 and lower clip feed rolls 54—54 all of which are supported on the upright frames 34—34. Each of the tools 30*a* and 32*a* and 30*b* and 32*b* have an anvil or forming jaw 30*c* and 32*c* for cradling (see FIG. 19) the borderwires and the coils of a mattress innerspring on which the individuals clips 52*a* and 54*a* of the interrconnected lines of clips are to be wrapped. As best illustrated in FIG. 20, each pair of the clip wrapping tools is positioned in spaced, vertical relation to one another with the anvils or forming jaws of the tools facing each other for reasons that will become clear as the description proceeds. In accordance with a preferred embodiment of the invention, each of the clip wrapping tools advantageously is provided with a removable front plate 30*d* and 32*d* (see FIGS. 20 and 21) which permits access to the reciprocatable blade 50 of the tools, and, if necessary, to any clips which may, for some reason, become jammed or locked in the tools. Removable pins 55 may be used to retain the front plates 30*d* and 32*d* on the tools.

As shown, a clip feed roll is provided for each of the tools 30*a*, 30*b*, 32*a* and 32*b*. The individual clips 52*a* and 54*a* which form the rolls 52—52 and 54—54 may take several different shapes. Illustrative of clips useful for the purposes of the present invention are those disclosed in U.S. Pat. No. 3,613,878. A preferred form of the clips and rolls are disclosed in U.S. Pat. No. 4,508,220. The clip feed rolls 52—52 and 54—54 are each advantageously removably supported between a pair of circular plate members or discs 56 and 58 positioned on a spindle 60 secured at one end to a common post or standard 34*a* extending upwardly from the base 34*b* of the upright frames 34—34. The interconnected clips are pulled from the clip rolls 52—52 and 54—54 by the action of the clip wrapping tools, and are guided along an upper track 62 and a lower track 64. A plurality of clip guides 66 are positioned along the tracks 62 and 64 at relatively closely spaced intervals in order to prevent the end of the interconnected clips 52*a* and 54*a* from leaving, or falling away from, the tracks 62 and 64 after the clips have been completely unwound from the clip rolls 52—52 and 54—54. The continuity of the clip severing and wrapping operation of the tools thereby is not in any way disrupted.

The upper track 62 is carried on a stationary block member 70 positioned on a rod 72 secured to the upper end of the post or standard 34*a* of the self-supporting upright frames 34—34. The upper track 62 also is attached to a movable block member 74 which rides back and forth on a rod 76 secured adjacent the upper ends of a pair of spaced, vertical posts or bars 34*c*—34*c* comprising the self-supporting upright frames 34—34. The sliding, oscillating action of the movable block member 74 acts to maintain the interconnected clips 52*a* being fed from the upper clip rolls 52—52 in proper alignment with the upper clip wrapping tools 30*a*—32*a*. For a similar reason, the lower track 64, like the upper track 62, is attached to a movable block member 80 which rides on a rod 82 secured adjacent to lower ends of the posts or bars 34*c*—34*c*. Only a single block member is required for the lower clip feed rolls 54—54 due to the relatively short distance between the rolls 54—54 and the lower clip wrapping tools 30*b* and 32*b*, and, also, due to the fact that the interconnected clips 54*a* pass over the top of the rolls 54—54 and not the bottom thereof as is the case with the upper rolls 52—52. This arrangement appreciably reduces the amount of slack as the clips are drawn off the rolls 54—54 by the lower tools.

Figure 7:
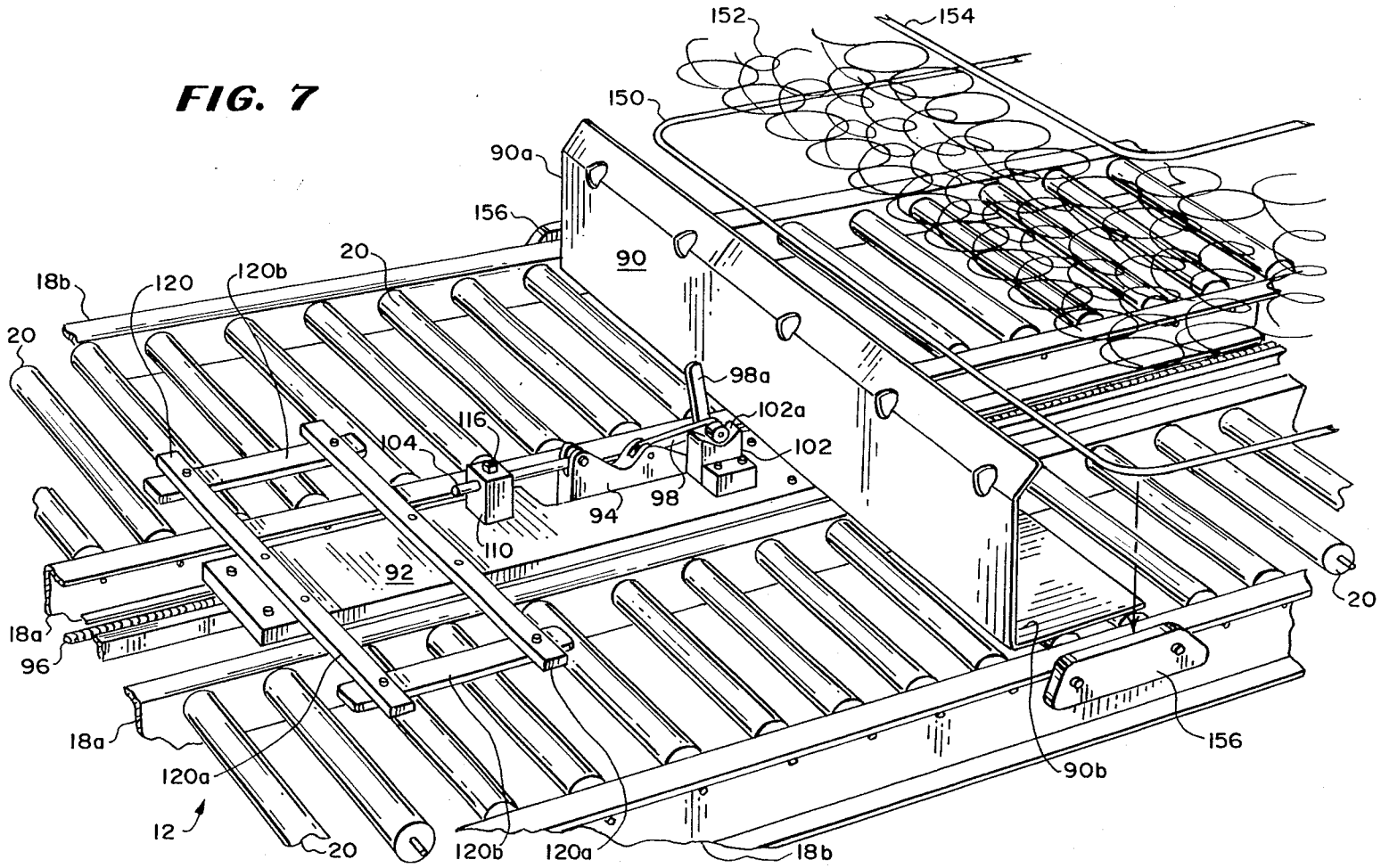
FIG. 7 is a fragmentary view in perspective of the support means, showing portions of the drive means and the borderwire and mattress innerspring alignment means.
Figure 11:
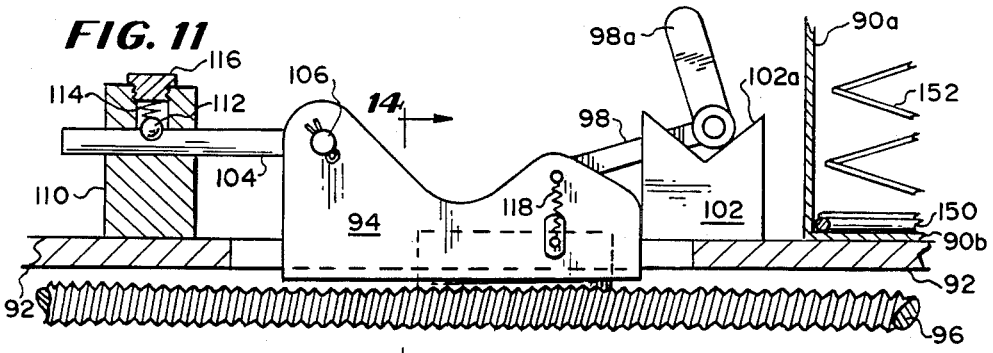
FIGS. 11 through 13 are fragmentary side views, partly in section, showing an embodiment of the drive means and carriage member for moving the pusher member along the support means.
Figure 12:
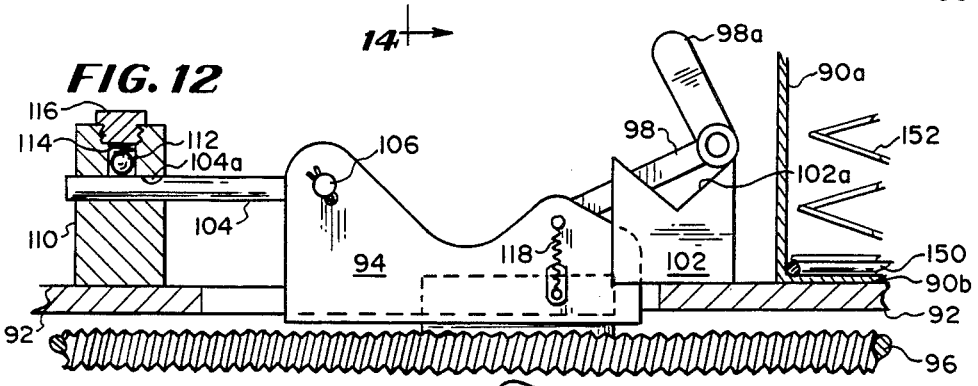
Figure 13:
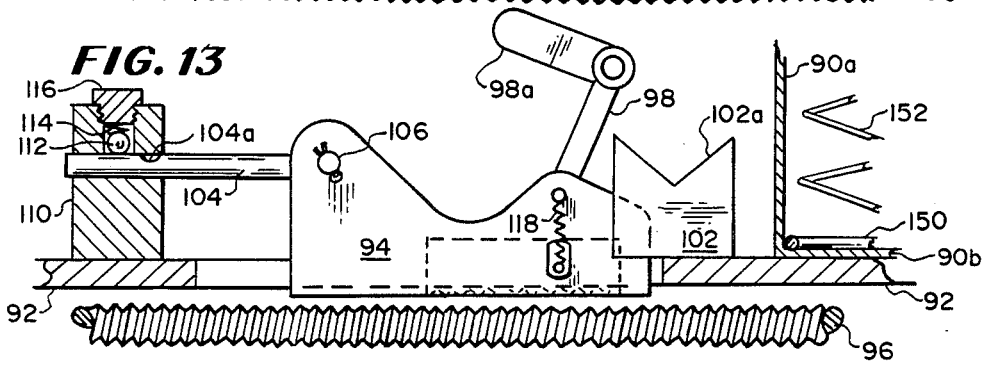
Figure 14:
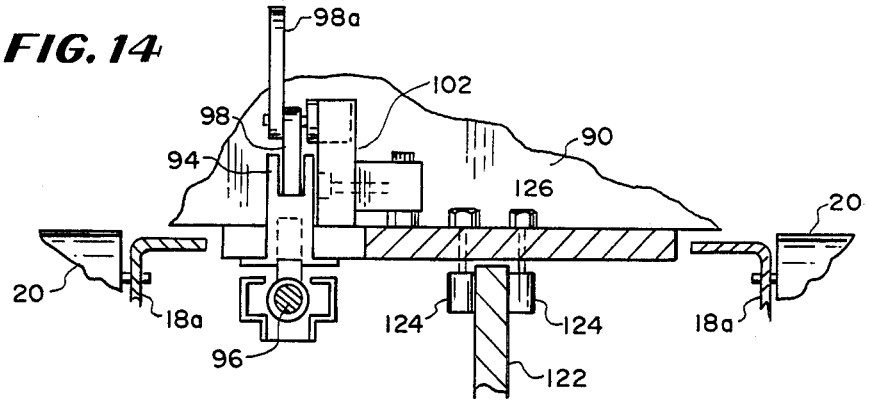
FIG. 14 is a fragmentary sectional view taken substantially along line 14—14 of FIG. 11.

As shown in FIGS. 1, 2, and 7, a movable, generally L-shaped pusher 90 is carried on the support means 12 transverse to the longitudinal axis thereof. The pusher 90 has a vertical leg portion 90*a* and a substantially horizontal leg portion 90*b*, and is secured to a horizontal plate member 92 which carries a carriage member 94. The member 94, is adapted to engage a drive screw 96 secured on the support means 12 between the inner channel members 18*a*—18*a* of the two rows of the conveyor sections 18—18. As shown in FIGS. 7 and 11 through 14, the carriage member 94 is provided with a handle-like release lever 98, the inner end of which is pivotally carried on a pin 100 extending through a bore 94*a* formed in the lead end of the member 94. An anchoring member 102, having a generally V-shaped notch 102*a* formed in the upper end thereof, is secured to the plate member 92. The free end or handle 98*a* of the lever 98 is normally received in the generally V-shaped notch 102*a*, as shown in FIG. 11, when the carriage member 94 is engaged with the drive screw 96. A rod 104 is attached to the rear end of the carriage member 94 by means of a pin 106. The free end of the rod 104 extends through a bore formed in a post 110 secured on the upper surface of the horizontal plate member 92. The rod 104 advantageously is provided with a detent 104*a* which normally receives a spring biased ball 112 held in position in the post 110 by a spring 114 and retaining bolt 116. A spring 118 is secured to the inner end of the lever 98 to maintain the handle 98*a* in a position clear of the notch 102*a* when the carriage member 94 is disengaged from the drive screw 96. The detent arrangement of the carriage 94 serves as a safety mechanism in the event that an obstruction is encountered while the pusher 90 is being advanced along the suppport means 12 by the drive screw 96. An obstruction will act to dislodge the ball 112 from the detent 104*a* in the rod 104 causing the carriage 94 to become disengaged from the drive screw 96. The reengage the carriage 94 with the drive screw 96, the lever 98 is raised to its up position as shown in FIG. 13, and the carriage is moved rearwardly, while holding the pusher 90 stationary, until the ball 112 is engaged in the detent 104*a*. The handle 98*a* is then positioned in the notch 102*a* to maintain the carriage 94 in engagement with the drive screw 96.

The horizontal plate member 92 also is provided, as shown in FIGS. 2 and 7, with a rectangularly shaped stabilizer member 120 which desirably is formed of parallelly arranged elongated bars 120*a*—120*a* and shorter side bars 120*b*—120*b*. The shorter bars 120*b*—120*b* are secured the undersides of the bars 120*a*—120*a* and are adapted to engage the conveyor rollers 20 comprising the conveyor sections 18—18. A plate guide member 122 (see FIG. 14) for the horizontal plate member 92 is secured to the support means 12. The plate member 122 rides between a pair of spaced, friction rollers 124—124 secured to the plate member 92 by bolts 126—126.

Figure 4:
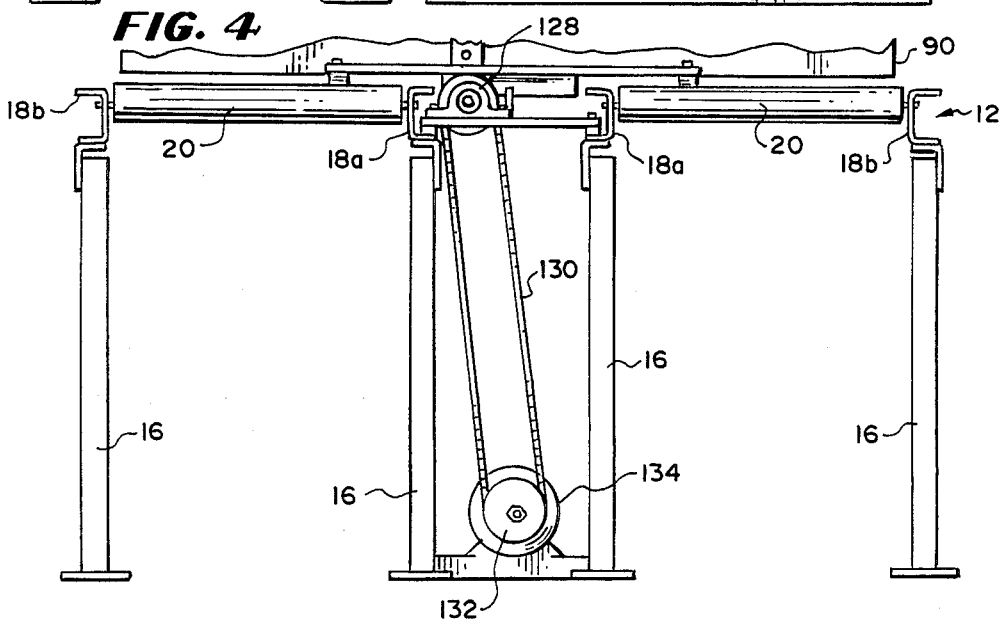
FIG. 4 is a fragmentary end view of the apparatus taken substantially along line 4—4 of FIG. 2.

As shown in FIGS. 1 and 4, the end of the drive screw 96 is provided with a pulley 128 which engages a drive belt 130 connected to a pulley 132 attached to the shaft of a motor 134 secured to the base of the support means 12. The motor 134 is provided with a brake and a clutch for controlling the forward and rearward movement of the pusher 90.

Figure 15:
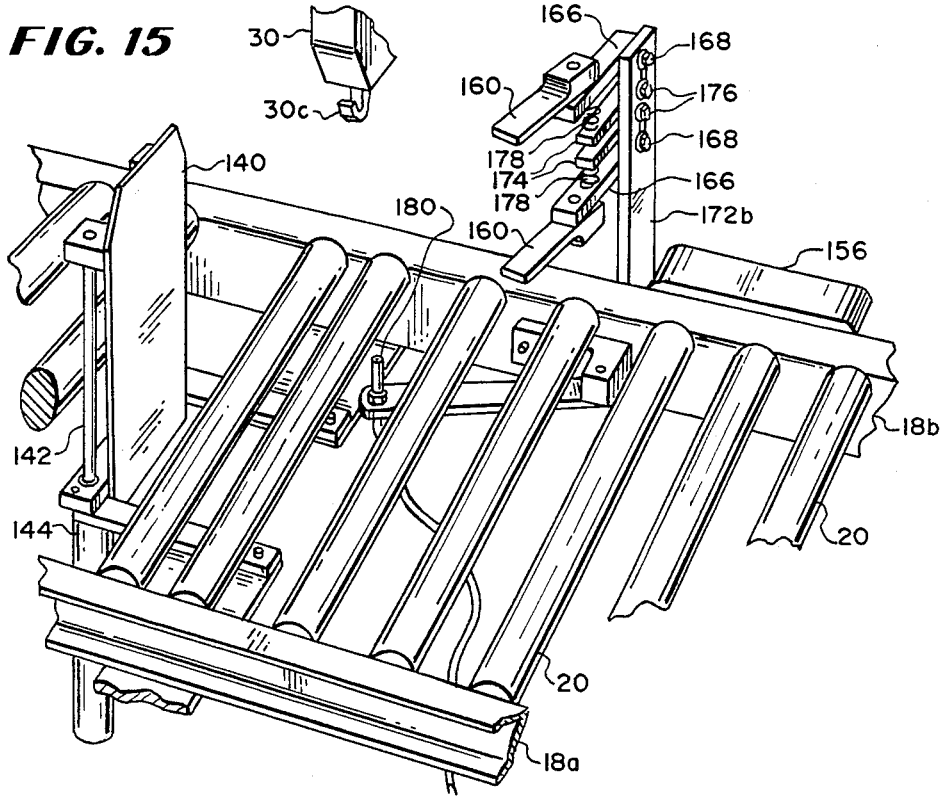
FIG. 15 is a fragmentary view in perspective showing the relationship of the coil sensing means, a clip wrapping tool, a vertically movable stop member of the alignment means; and the borderwire spacer means to the support means.

The support means 12 also is provided with a pair of spaced, vertically retractable stop plates 140—140 which are positioned between the rollers 20 of the conveyor sections 18—18 at the inner or free end of the drive screw 96 adjacent to the clip wrapping tools 30*a*—32*a* (see FIG. 2). The stop plates 140—140 are each carried on piston rods 142—142 of air cylinders 144—144 secured on the support means 12. As illustrated in FIGS. 1, 7 and 15 of the drawings, the stop plates 140—140 are in a raised position prior to initiating the clip wrapping operation.

Figure 8:
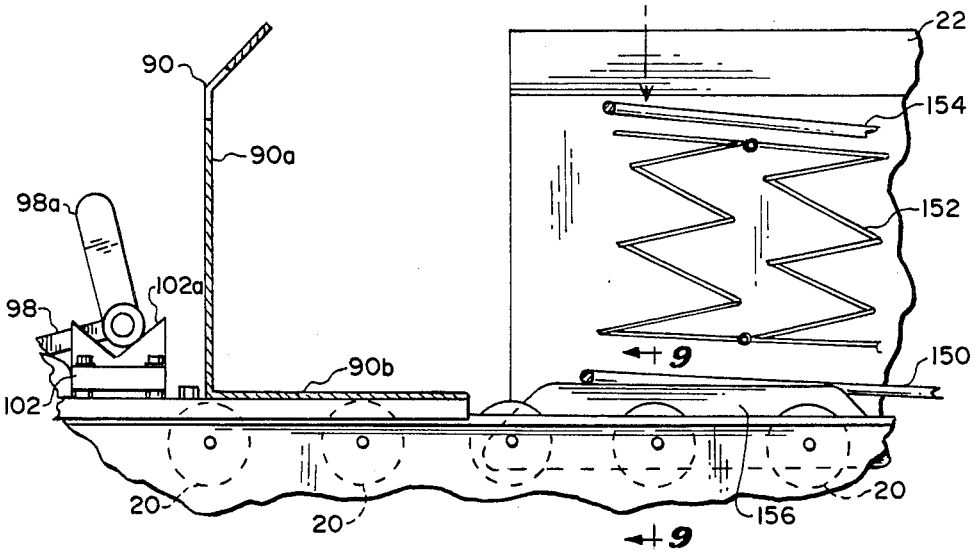
FIG. 8 is a fragmentary side, partly in section, showing the borderwires and mattress innerspring in stacked relation on the support means just prior to engaging the pusher member comprising the alignment means with the rear end of the borderwires and the mattress innerspring.
Figure 9:
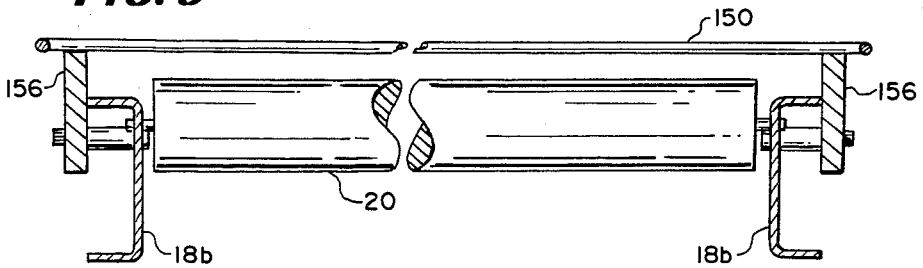
FIG. 9 is a fragmentary sectional view taken substantially along line 9—9 of FIG. 8.
Figure 10:
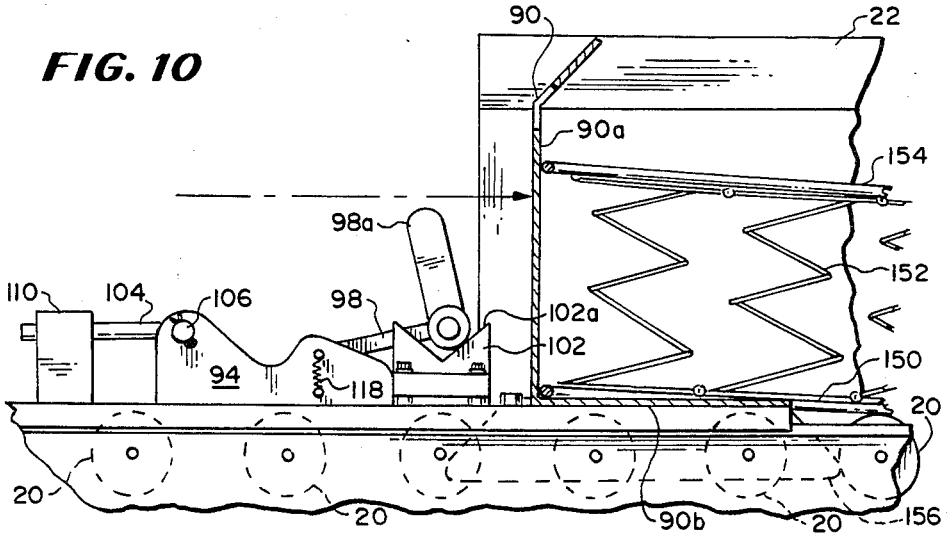
FIG. 10 is a view corresponding to the view of FIG. 8, showing the horizontally movable pusher member of the alignment means in contact with the rear end of the borderwires and mattress innerspring.
Figure 22:
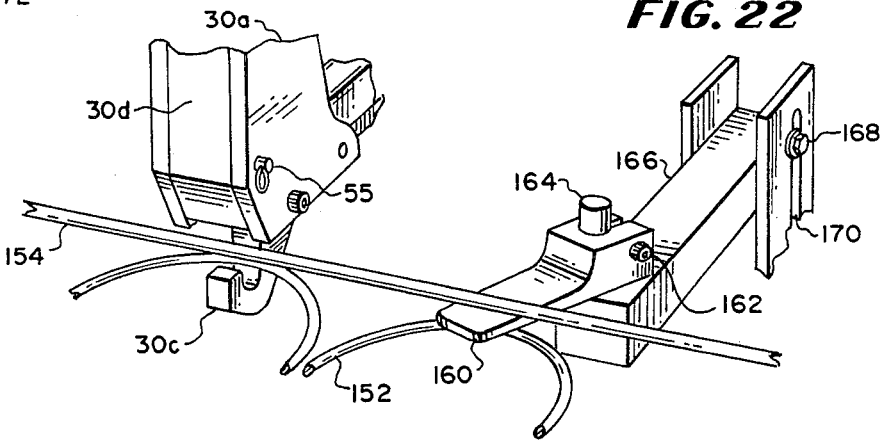
FIG. 22 is a fragmentary view in perspective showing the position of the borderwire spacer means just prior to a clip wrapping sequence by an adjacent clip wrapping tool.

In utilizing that portion of the apparatus shown in FIG. 1, a bottom borderwire 150 is first positioned on the conveyor sections 18—18 by an operator, followed by a mattress innerspring 152 and a top borderwire 154. As best shown in FIGS. 8 through 10, the rear section of the bottom borderwire 150 initially rests on shoes 156—156 secured to the outer top margin of the outer channel members 18*b*—18*b* of the conveyor sections 18—18. The shoes 156—156 act to raise the rearwardmost end of the bottom borderwire 150 a sufficient distance to enable the horizontal leg 90*a* of the pusher 90 to be positioned under the stacked bottom borderwire 150, the mattress innerspring 152 and the top borderwire 154. At the lead end of the bottom borderwire 150 and the top borderwire 154, a pair of vertically spaced movable separator or spacer arms 160—160 is provided on each of the upright frames 34—34. As best shown in FIGS. 20 and 22, the uppermost of each pair of the separators or spacer arms 160—160 underlie the top borderwire 154 and serve to maintain the leading end portion of the top borderwire 154 in spaced relation to the coils 152*a* of the mattress innerspring 152. The lowermost of each pair of the separators or spacers 160—160 overlie the bottom borderwire 150, and serve to maintain the leading end portion of the bottom borderwire 150 in spaced relation to the coils 152*a* of the mattress innerspring 152. The spacer or separator arms 160—160 advantageously are positioned adjacent to but rearwardly of the point at which clips are wrapped on the borderwires 150 and 154 and the coils of the mattress innerspring 152. Each of the arms 160—160 is secured by a set screw 162 on a post 164 carried by a rockably mounted bar 166 which is attached by a bolt 168 extending through a vertical slot 170 formed in an L-shaped bracket 172, the horizontal leg 172*A* of which is secured to outer channel members 18*b*—18*b* of the conveyor sections 18—18. A second, vertically adjustable bar 174 is secured in spaced relation to each of the bars 166 by a screw 176 which extends through the slots 170 in the vertical leg 172*b* of the bracket 172. A compression spring 178 is positioned between each of the bars 166 and 174 to enable the arms 160—160 to move downwardly against the tension of the springs 178 in response to the clip wrapping action of the clip wrapping tools thereby preventing the arms 160—160 from becoming displaced from their position between the bottom and top borderwires 150 and 154 and the coils of the mattress innerspring 152.

Figure 16:
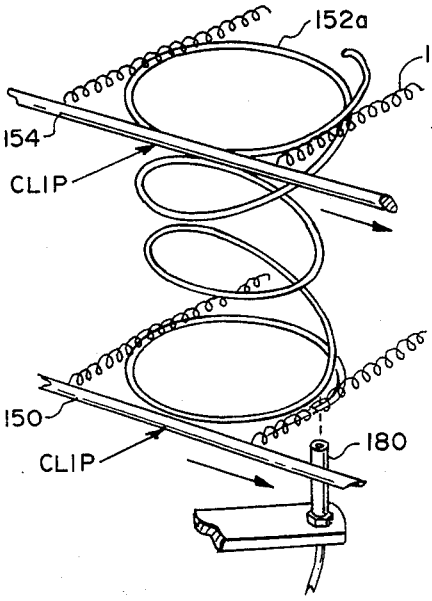
FIGS. 16 and 17 are fragmentary views in perspective showing an arrangement of the coil sensing means with relation to the individual coils of a mattress innerspring when clips are being wrapped along the sides, and the ends, of the mattress innerspring.
Figure 17:
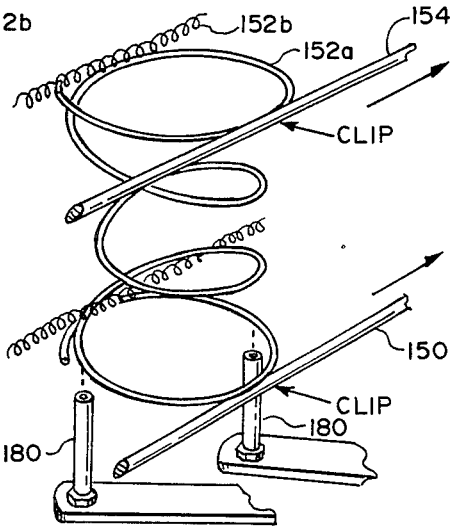
Figure 18:
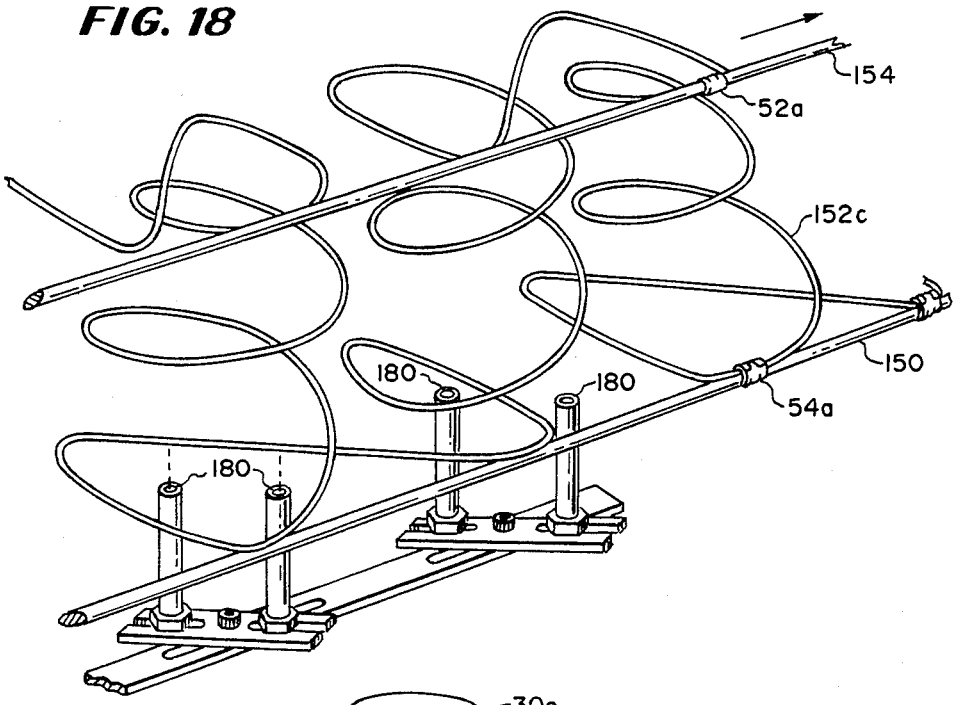
FIG. 18 is a view in perspective showing an arrangement of the coil sensing means and the continuous coil of a mattress innerspring being wrapped with clips with the apparatus of this invention.

Referring, now, to FIGS. 16, 17 and 18 of the drawings, sensing means, advantageously in the form of pairs of fiber optic elements or units 180—180, are positioned below and between the rollers 20 of the conveyor sections 18—18 at a point forwardly of the upper clip wrapping tools 30*a* and 32*a*. The sensors 180—180 act to accurately and consistently send a signal to the control means when a coil 152*a*, or helicoil 152*b*, of the mattress innerspring is in a clip wrapping position with relation to the clip wrapping tools. The sensors 180—180 are initially oriented so that the first coil that comes within the viewing range of the sensor is the penultimate or second coil a the lead end of the mattress innerspring 152. Due to the curvature of the coils at the corners of the mattress innerspring 152, and the straight-line alignment of the clip wrapping tools with relation to the coils along the side margins of the mattress innerspring, the coils at the rounded corners of the mattress innerspring cannot be properly wrapped with a clip by the tools. The corners, therefore, are secured to the borderwires manually after the apparatus has automatically wrapped clips along all four sides of the mattress innerspring. As shown in FIG. 16, the sensor 180 is aligned with a helicoil 152*b* of a mattress innerspring 152 comprising individual or separate coils, and will transmit a signal to the control means when the helicoil is in the sensors viewing range as the mattress innerspring is advanced in the direction indicated by the arrows. In FIG. 17 the sensors 180 are aligned to transmit a signal when a coil 152*a* is in their viewing range when the mattress innerspring is advanced in the direction indicated by the arrows. In FIG. 18, the arrangement of the sensors 180—180 with the coils is shown when the mattress innerspring is formed of a continuous coil 152*c*.

Figure 28:
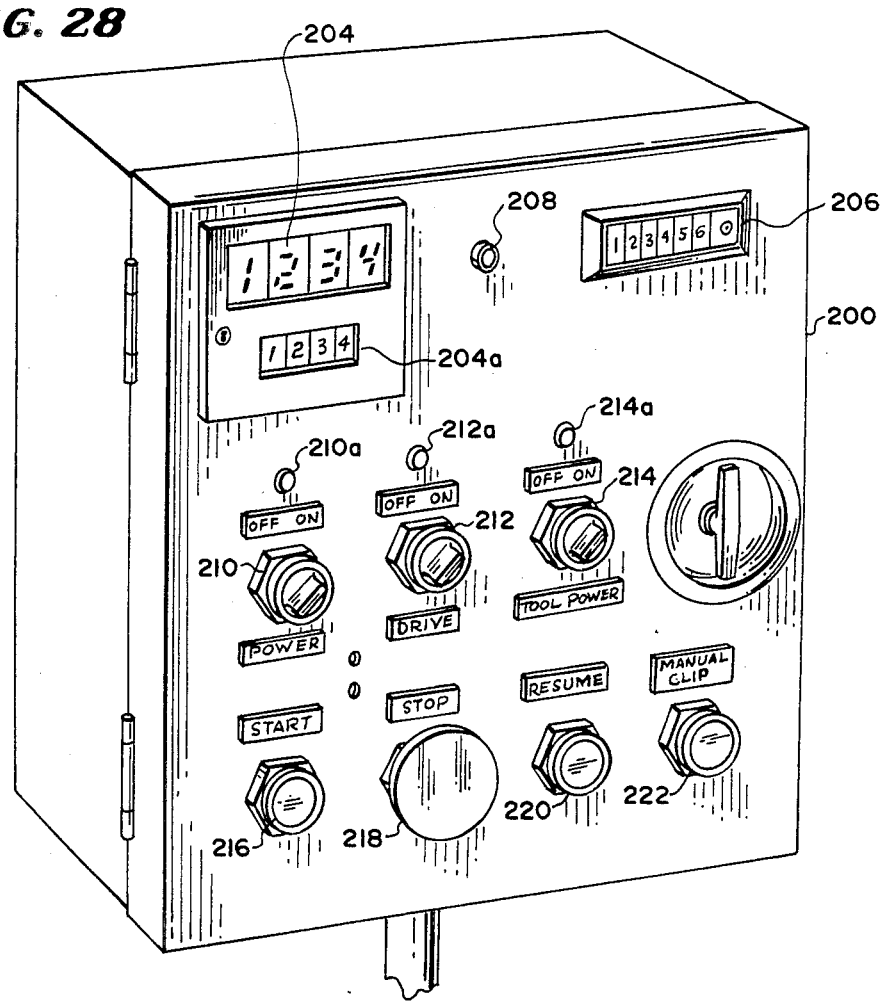
FIG. 28 is a view in perspective of the main control panel of the apparatus.
Figure 29:
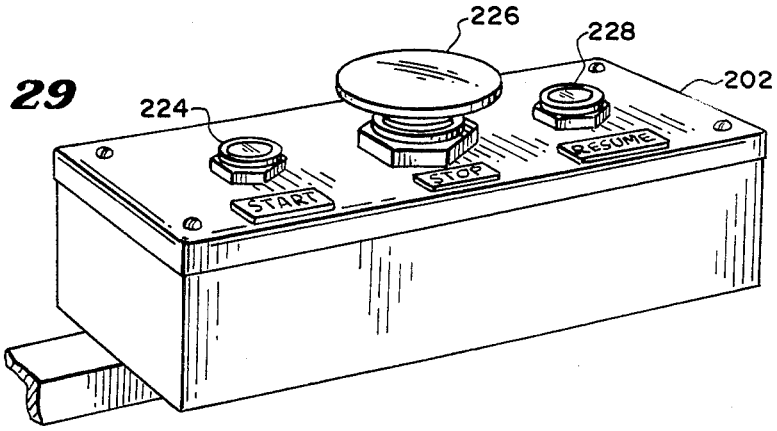
FIG. 29 is a view in perspective of the auxiliary control panel of the apparatus.

Operation of the apparatus advantageously is controlled by means of a main control panel 200 and an auxiliary control panel 202. Embodiments of such control panels are illustrated in FIGS. 28 and 29. As shown in FIG. 1, the main control panel 200 is positioned adjacent to the support means 12, and may be free-standing or secured directly to the support means. The auxiliary control panel 202, as shown in FIG. 2, may be positioned on one of the frames 34, or any desired location easily accessible to the operator.

The main control panel 200 has a counter 204 which totalizes the number of coils on each side of the mattress innerspring on which clips have been wrapped by the clip wrapping tools, and an indicator 204*a* which shows the pre-set number of clips to be wrapped on each side. As stated above, the number of coils wrapped will be two less than the total number of coils on each side of the mattress innerspring because the clip wrapping tools do not wrap clips on the end or corner coils. The panel 200 also desirably has a counter 206 which totalizes the number of units, that is, mattress springs with borderwires secured thereto, which have been produced by the apparatus. An indicator 208 on the panel 200 visually indicates when the clip wrapping tools have been activated. The panel 200 also is provided with a main power switch 210 which supplies power to the machine circuitry; a drive power switch 212 which supplies power to the drive motor 134; a tool power switch 214 which supplies power to solenoid valves which in turn activate the clip wrapping tools; a start cycle pushbutton switch 216 which is used to initiate a clip wrapping cycle; a stop cycle pushbutton switch 218 which deenergizes all circuit elements; a resume cycle pushbutton switch 220 which energizes the circuit elements necessary to continue a clip wrapping cycle; and a manual pushbutton switch 222 which activates the clip wrapping tools. The switches 210, 212, and 214 are each advantageously provided with indicator lights 210*a*, 212*a* and 214*a* which visually show when the switches are in the "on" position.

The auxiliary control panel 202 has a start cycle pushbutton switch 224; a stop cycle pushbutton switch 226; and a resume cycle switch 22, each of which performs a function corresponding to that of the switches 216, 218 and 220 of the main control panel 200.

DESCRIPTION OF THE PREFERRED EMBODIMENT OF THE ELECTRICAL SYSTEM

Figure 26:
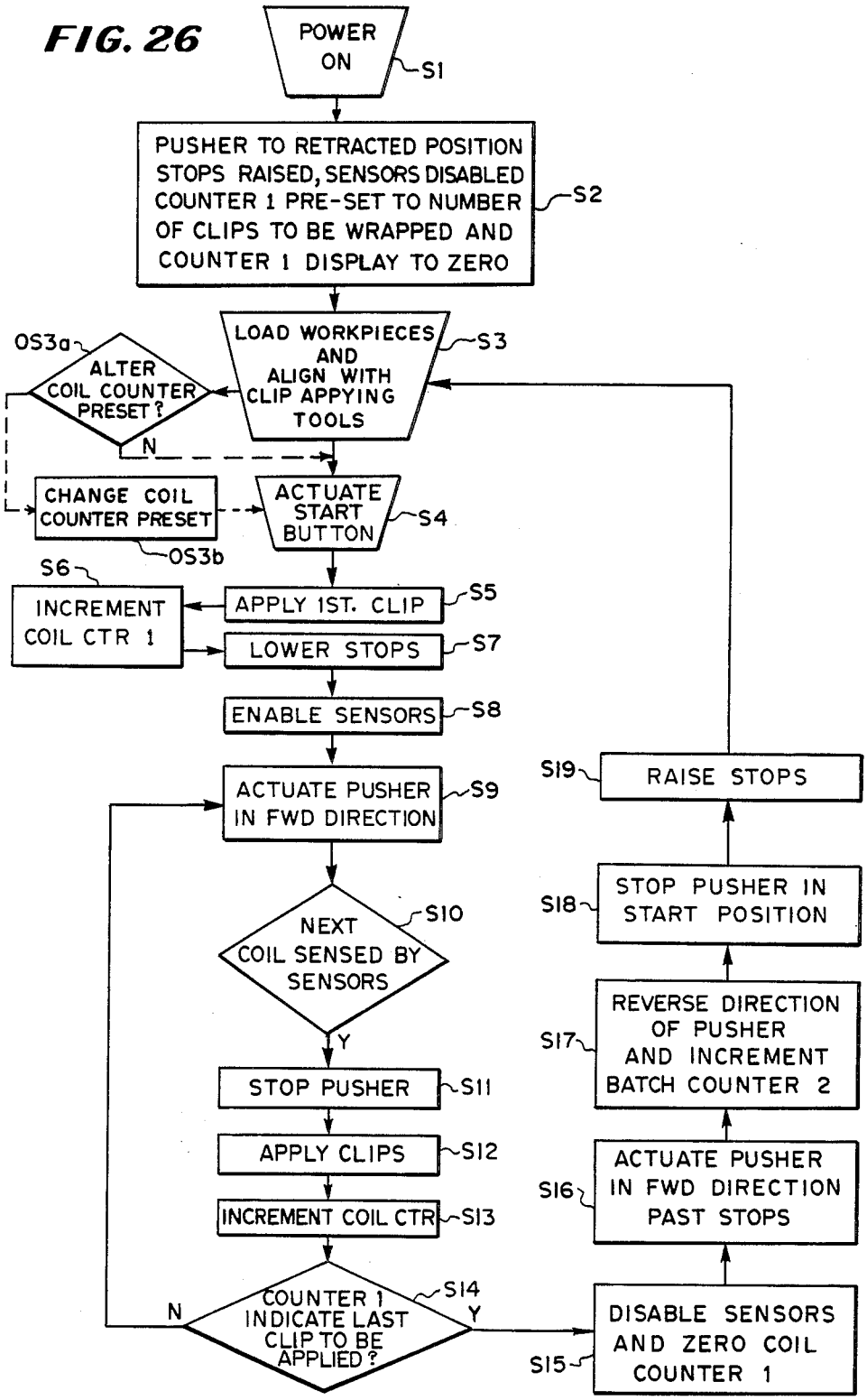
FIG. 26 is a flow diagram showing the sequence of operations in wrapping clips on borderwires and the coils of an innerspring mattress with the apparatus.

In FIG. 26, block S1 indicates that the power is applied to the system by the operator by means of switch 210. Block S2 indicates that the pusher 90 will be in its fully retracted position, that the stop plates 140—140 will be raised, that clip counter 204 will be zeroed, and that coil position sensors 180—180 will be disabled. The operator then loads work pieces on the support means 12 in the order illustrated in FIG. 1, and manually aligns them with the clip wrapping tools according to block S3 utilizing the pusher 90, which has been disengaged from the drive screw 96, for this purpose. The operator then actuates the start switch 216, or 224, whichever is nearer at hand to the operator, in accordance with block S4 automatically to effect several operations that occur in close sequence. In block S5 the tools simultaneously wrap the first clip on the second coils of the mattress innerspring 152, and the borderwires 150 and 154. In block S6 the clip counter 204 is incremented one step. In block S7 the stop plates 140—140 are lowered, and in block S8 the coil position sensors 180—180 are energized. Lastly, block S9 indicates that the pusher 90 has been engaged with the drive screw 96 by moving the handle 98*a*, secured to the carriage 94, into the notch 102*a* of the member 102 carried on the plate 92, and has been actuated to its workpiece-advancing position.

Decision block S10 determines whether the next coil has been sensed by the coil sensors 180—180. When it has been sensed, the pusher 90 is stopped by action of the brake on the drive motor 132, and the clips are wrapped by the tools. The counter is incremented one step as is indicated by steps S11, S12 and S13. Decision block S14 then determines whether the last clip has been applied to the workpieces, and if not, the sequencing returns to step S9 to actuate the pusher 90 in the forward direction. The device then cycles through step S9 through S14 the required number of times until the last clip has been wrapped on the borderwires 150 and 154 and the coils of the mattress innerspring 152 as determined by the pre-set number of clips on the indicator 204*a*.

When the last clip has been wrapped on the workpieces, step S15 disables the sensors 180—180, and step S16 actuates the pusher 90 in the forward direction past the stop plates 140—140. Step 17 then automatically reverses the direction of the drive screw 96 until the pusher 90 reaches the start position at which time the pusher 90 is stopped at step S18. Step S19 then raises the stop plates 140—140 and the device is ready for a new set of workpieces. The operator then actuates the start button 216, and the device cycles through steps S5 through S19 automatically.

The foregoing sequence of steps can be effected by any means desired such as relays, hard wired logic, or a software programmed general purpose or special purpose computer.

Figure 27:
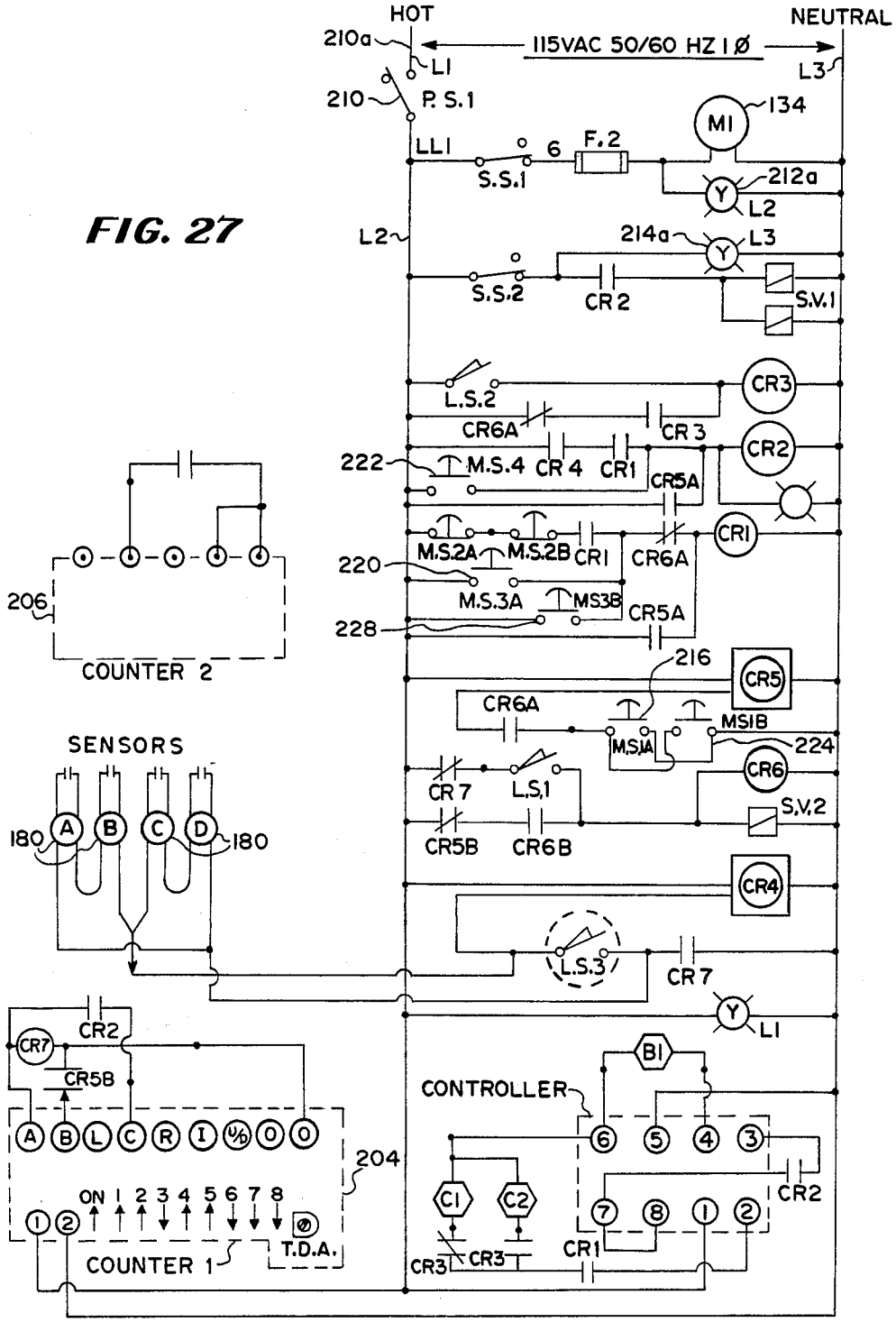
FIG. 27 is a logic circuit diagram of an embodiment of control means for carrying out the various operations of the apparatus.

In FIG. 27, an embodiment of a hard wired relay logic that effects the functional steps of the device described in conjunction with FIG. 26 is illustrated.

Motor 134 supplies the mechanical force to actuate the pusher 90 in the forward direction to motor clutch C1 and in the reverse direction to motor clutch C2. Motor brake Bl operates to stop the motion of the pusher 90 when the pusher has been uncoupled from the motor 134 by the clutch C1 opening. Control relay CR1 partially controls the application of mechanical power from motor 134 through clutches C1 and C2 to the pusher 90 as will be described.

Power to the clip wrapping tools is provided through solenoid air valves SV1 and the movement of the stop plates 140—140 is controlled by solenoid air valve SV2, the operation of which also will be described.

Power is supplied to the device by closure of power switch 210. This applies hot 115 volt AC 50/60 cycle, single phase power from lead L1 to lead L2. The neutral of the power is applied to lead L3. Connected between leads L2 and L3 are the switches 212, 214, 216, 218, 220 and 220, control relays and lamps 208, 210*a*, 212*a* and 214*a*, in addition to the motor 134 and solenoid air valves previously described.

Upon application of power to lead L2, the first and only control relay to energize is CR6 through the normally closed contacts CR7 and limit switch LS1, which normally is closed. This raises the stop plates 140—140 in preparation for the borderwires 150 and 154, and the mattress innerspring 152 to be positioned on the support means 12 and to be aligned with the clip wrapping tools. Control relay CR6 latches in the active state through normally closed contacts CR5B and normally open contacts CR6*b*. This latches the stop plates 140—140 in the raised position.

Power-up also resets to zero the clip counter 204. The coil position sensors 180—180 are controlled through control relay CR7, which normally is inactive upon power-up.

Actuating either one of the start buttons 216 or 224 energizes the control relay CR5 through the closed normally open contacts CR6A. Control relay CR5 is a one-shot time delay relay providing approximately a one-second energize cycle.

Control relay CR5 effects four different functions to start the operation cycle of the device. Control relay CR5 effects the application of the first clip onto the workpieces by actuating control relay CR2 to energize the tool actuator solenoid air valves SV1. This occurs through normally open contacts CR5A applying power to control relay CR2, which in turn closes its normally open contacts CR2 to apply power across the solenoid air valves SV1. Selector switch S.S.2 normally is closed except for maintenance purposes. Lamp L3 indicates closure of the selector switch S.S.2. The normally open contacts CR2 also close at counter 204 between terminals A and C to increment the counter one step. Control relay CR2 energizes only for the one-shot time sequence of control relay CR5.

Control relay CR5 further energizes master run relay CR1 through the closing of normally open contacts CR5A. This sets the device in a run condition preparatory for the pusher 90 to move the workpieces past the clip wrapping tools. Control relay CR5A also energizes control relay CR7 at counter 204 by closing its normally open contacts CR5B. This enables the sensors through the closing of normally open contacts CR7, and in conjunction with the opening of the normally closed contacts CR5B together with the opening of normally closed contacts CR7, lowers the stops 140—140 by de-energizing control relay CR6 and solenoid air valve SV2.

Referring to the controller at the bottom of FIG. 27, the closing of the normally open contacts CR1 by control relay 1 becoming energized enables the activation of clutch C1 or C2 of the motor 134 depending upon the activated state of control relay CR3. Clutch C1 and brake Bl of the motor 134 are used only in the forward direction of the pusher 90 while clutch C2 is used only in the reverse direction for the pusher. When the contacts CR2 are normally open in the interval when the pusher 90 is moving the workpieces from one clipping location to another clipping location, power flows between pins 2 and 6 of the controller to energize the selected clutch. When the normally open contacts CR2 close to operate the clip wrapping tools, power is removed from between pins 2 and 6 of the controller and power is applied between pins 4 and 6 of the controller. This disengages the clutch C1 and engages the brake Bl to bring the workpieces to a stop at the clip wrapping tools. When the normally open contacts CR2 again open at the end of the clip wrapping operation, power ceases to flow between pins 4 and 6 of the controller de-energizing the brake Bl and resumes flowing between pins 2 and 6 of the controller re-energizing clutch C1.

When the sensors 180—180 detect the presence at the proper location of a coil, or helicoil, of the mattress innerspring, they act as if to close limit switch LS3. In conjunction with the normally open contacts of CR7 being closed due to the activation of control relay CR7, control relay CR4 activates. Control relay CR4 is a one-shot relay that produces a one-half-second closure of normally open contacts CR4 that, in conjunction with the normally open contacts of CR1 also being closed, activates control relay CR2 to actuate the clip wrapping tools. The activation of control relay CR2 stops the pusher 90 by control of brake Bl and C1 at the controller, wrap the clips by activation of the solenoid air valves SV1 and increments the counter 204 by closing the normally open contacts CR2 across terminals A and C. After one-shot control relay CR4 opens, the normally opened contacts CR4 again open, which ends the wrapping of the clips to the workpieces and allows the pusher 90 to proceed to the next work location.

When the last clip has been applied as determined by the count programmed into counter 204*a*, counter 204 de-energizes control relay CR7 to disable the sensors 180—180 by opening normally open contacts CR7 and further enables raising of the stop plates 140—140 through control relay CR6 by closing the normally closed contacts CR7. The pusher 90 then moves the workpieces in the forward direction until it closes normally open limit switch L.S.2 to energize control relay CR3. Control relay CR3 latches through the normally closed contacts CR6A and its own closure of normally open contacts CR3.

At the controller, the normally closed contacts CR3 to clutch C1 open, and the normally open contacts CR3 to clutch C2 close applying mechanical power from the motor 134 through clutch C2 and a reversing transmission to bring the pusher 90 to the start position. At counter 2, the closure of the normally open contacts CR3 effect a count of a completion of another workpiece on the counter 206.

When the pusher returns to the start position, it closes limit switch LS1 again to energize control relay CR6 to raise the stops 140—140 through solenoid air valve SV2. This opens the normally closed contacts CR6A at the master run relay CR1 to disengage both clutches C1 and C2 through the opening of contacts CR1 at the controller.

Control relay CR3 then de-activates through the opening of limit switch LS2 as the workpieces move away therefrom and through the opening of normally closed contacts CR6A in series with control relay CR3.

The circuit thus is reset awaiting another closure of the start buttons 216 or 224 to initiate another work cycle through activation of control relay CR5.

Momentary switches MS2A and MS2B provide stop cycle functions by de-energizing master run relay CR1 as desired. Momentary switches 220 and 228 provide resuming the clip wrapping cycle when desired by re-energizing master run relay CR1. Momentary switch 222 provides for a manual activation of control relay CR2 and the clip wrapping tools, brake-clutch combination and the counter 204 as desired.

Indicator lamp 210*a* lights when the power switch 210 is closed to indicate power available between leads L2 and L3. Lamp 212*a* lights when power is applied to motor 134. Lamp 214*a* lights when selector switch S2 is closed to enable power to be applied to the solenoid air valves SV1.

Figure 5:
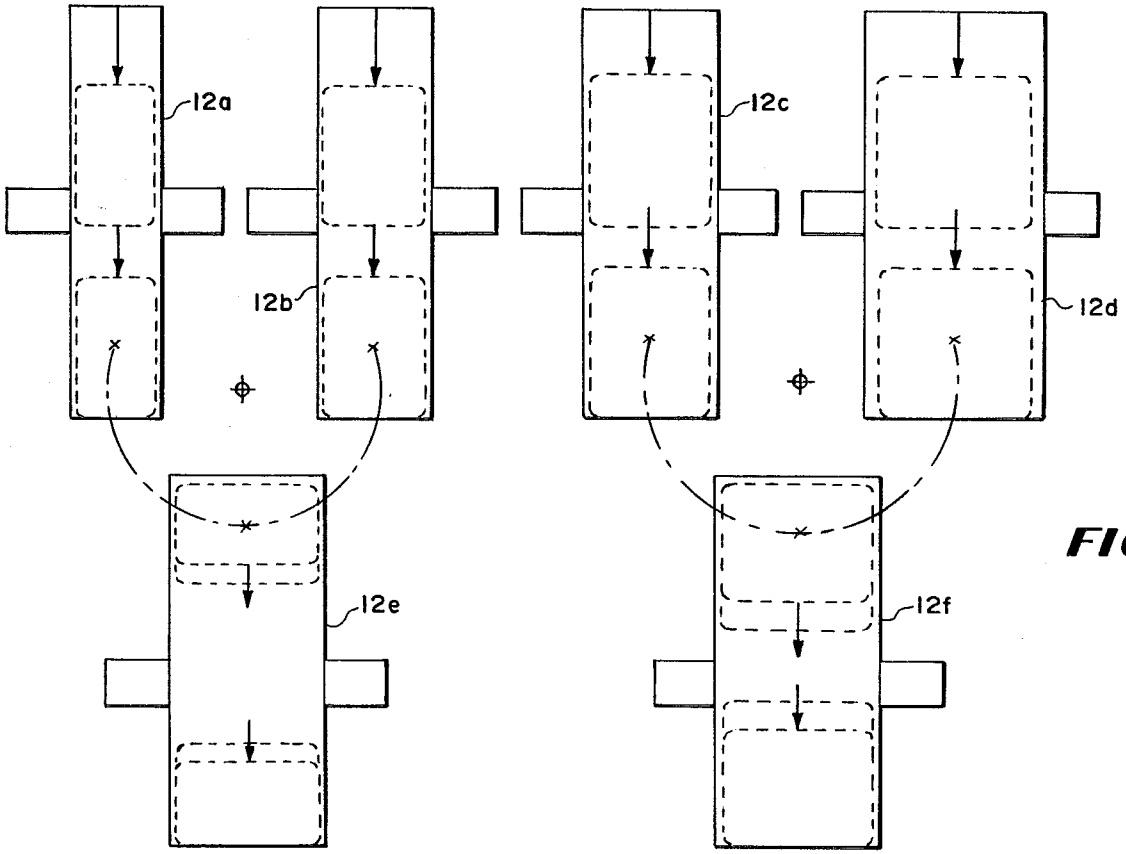
FIG. 5 is a schematic representation of arrangements of the support means for wrapping clips first on the sides and then the ends of a mattress innerspring and the borderwires.
Figure 6:
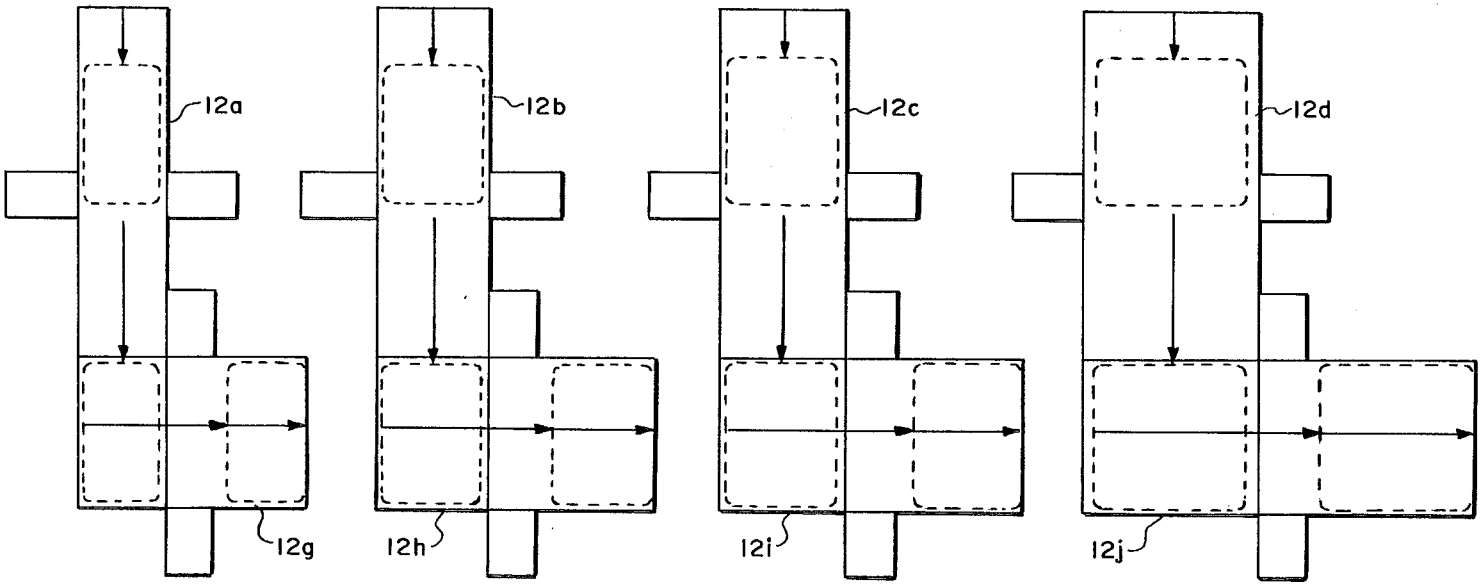
FIG. 6 is a view similar to the view of FIG. 5 showing variations of the arrangement of the support means for wrapping clips first on the sides and then on the ends of a mattress innerspring and the borderwires.

After clips have been wrapped on both sides of the borderwires and the mattress innerspring with the portion of the apparatus shown in FIGS. 1 and 2, the resulting structure desirably is transferred by hand, or by machine, to a second or auxiliary support means. FIGS. 5 and 6 illustrate diagramatically various alternative plans for first wrapping clips on the sides and then the ends of the borderwires and the mattress innerspring. In FIGS. 5 and 6, the support means 12*a* and 12*b* represent variations of the support means 12 for use in wrapping clips on the sides of borderwires and mattress innersprings of the type utilized for making twin size mattresses. The support means 12*c* and 12*d* illustrated in FIGS. 5 and 6 represent variations of the support means 12 for use in wrapping clips on the borderwires and mattress innersprings of the type used for making king size and queen size mattresses. In FIG. 5, auxiliary support means, designated by reference numeral 12*e* serves to wrap clips on the ends of the structures from support means 12*a* and 12*b*, while auxiliary support means 12*f* serves the same function with respect to the structures formed on support means 12*c* and 12*d*.

In FIG. 6, each of the support means 12*a*, 12*b*, 12*c* and 12*e* is associated with auxiliary support means 12*g*, 12*b*, 12*i* and 12*j*, respectively. Each auxiliary support means is positioned at a right angle with respect to the lead or forward end of its associated support means 12*a*, 12*b*, 12*c* or 12*d* whereby the direction of travel only of the structure formed on the support means 12*a*, 12*b*, 12*c* and 12*d* needs to be changed to place it in a position on the auxiliary support means 12*g*, 12*h*, 12*i* and 12*j* whereby the ends thereof are secured by the clip wrapping tools provided for the auxiliary support means.

Figure 23:
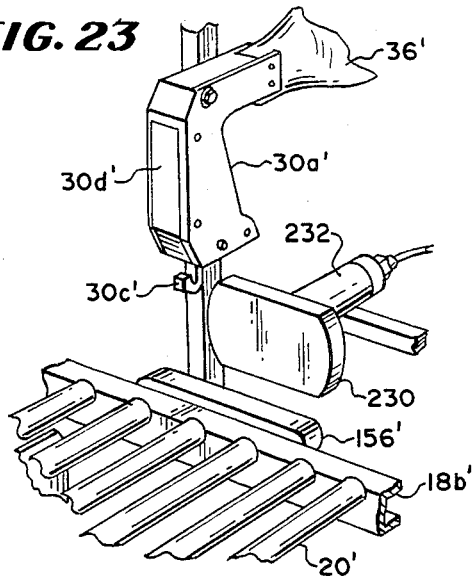
FIG. 23 is a fragmentary view in perspective showing the relationship of the reciprocatable coil engaging means and a clip wrapping tool of the apparatus.
Figure 24:
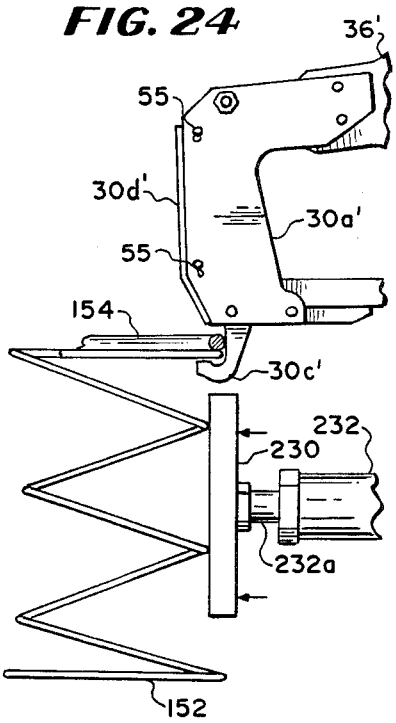
FIG. 24 is a fragmentary side view in elevation showing the reciprocatable coil engaging means in contact with the coils of a mattress innerspring during a clip wrapping sequence.
Figure 25:
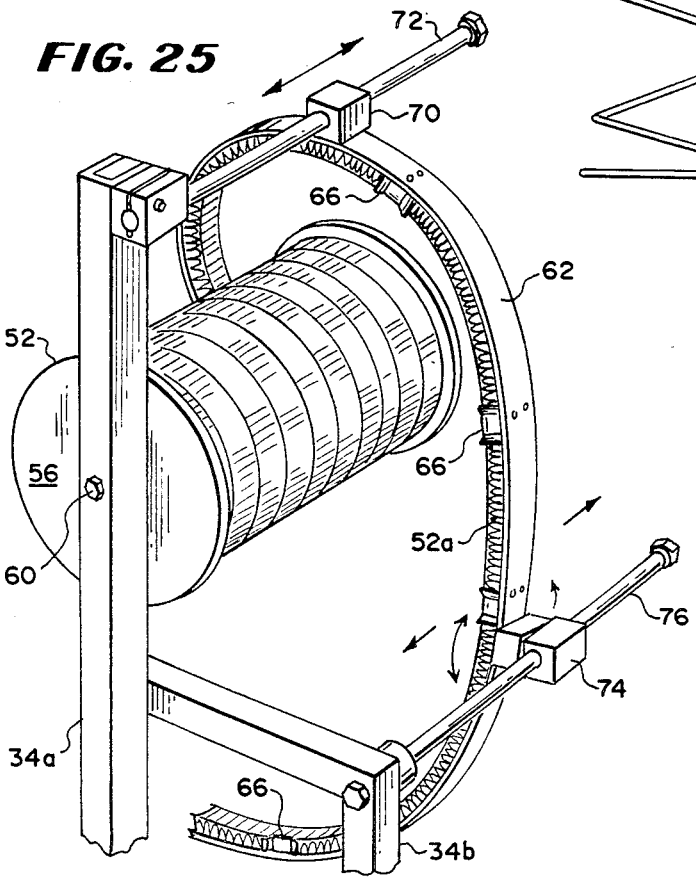
FIG. 25 is a fragmentary view in perspective of a clip feed roll employed with the apparatus.

Each of the auxiliary support means shown in FIGS. 5 and 6 comprise, as in the case of the support means 12, a support frame on which are positioned conveyor sections 18' having channel members 18*a'* and rollers 20' (see FIGS. 23 and 24). Pairs of clip wrapping tools, one of which is illustrated in FIGS. 23 and 24 and designated by reference numeral 30*a'*, are positioned on each side of the auxiliary support means as schematically illustrated by boxes in FIGS. 5 and 6. The auxiliary support means also is provided with a pusher, a drive motor, a drive screw, coil sensing means, and control means as in the case of the support means 12. Since the structure on which the clips are wrapped on the auxiliary support means is a relatively rigid, integrated one, it is not necessary to utilize spring biased spacer or separator arms to maintain the ends of the borderwires in proper orientation with respect to the end coils of the mattress innerspring. However, in a preferred embodiment of the invention, a reciprocatable, spring engaging plate member 230 advantageously is used for this purpose. As best illustrated in FIGS. 23 and 24, the spring engaging plate member 230 is secured to the piston rod 232*a* of an air cylinder 232. The reciprocatable plate 230 acts to depress the coils at each end of the mattress innerspring 152 inwardly to position the coils in proper alignment with the borderwires 150 and 154 during a clip wrapping operation by the tools, only one of which, designated 30', is shown. The air cylinder 232 is in synchronous operation with the tools, and the plate member 230 only comes into contact with the spring coils when the clip wrapping tools are activated. The control means used to wrap clips on the side of the workpieces are used to control the wrapping of clips on the ends of the workpieces.

It should be understood that numerous modifications may be made to the preferred embodiment of the invention shown and described without deviating from the broader aspects of the same.

What is claimed:

1. Apparatus for automatically securing borderwires on mattress innersprings, comprising: mattress innerspring and borderwire support means on which a mattress innerspring and borderwires are positioned in stacked relation; alignment means associated with the support means for maintaining a mattress innerspring and borderwires in aligned relation to one another on said support means; clip wrapping means positioned adjacent to said support means for simultaneously wrapping a plurality of clips on the borderwires and the coils along the margins of the mattress innerspring to secure the borderwires to the mattress innerspring; and control means for sequentially actuating the clip wrapping means whereby the borderwires are successively secured to the coils along the margins of the mattress innerspring.

2. Apparatus according to claim 1 wherein the alignment means includes a horizontally movable member which serves to move the mattress innerspring and the borderwires along said support means in the direction of the clip wrapping means.

3. Apparatus according to claim 2 wherein motor drive means is provided for the movable member of the alignment means.

4. Apparatus according to claim 3 wherein a drive screw is connected to said motor drive means for advancing the movable member along the support means.

5. Apparatus according to claim 4 wherein releasable drive screw engaging means is provided for said movable member.

6. Apparatus according to claim 1 wherein the alignment means includes movable stop means for engaging an end of the mattress innerspring and the borderwires when they are positioned in stacked relation on the support means.

7. Apparatus according to claim 1 wherein borderwire spacer means is provided for maintaining the borderwires in spaced apart relation to the coils along the margins of the mattress innerspring as the clips are wrapped by the clip wrapping means.

8. Apparatus according to claim 7 wherein the borderwire spacer means is spring loaded.

9. Apparatus according to claim 1 wherein the clip wrapping means includes a plurality of clip wrapping tools for simultaneously wrapping clips on the borderwires and a plurality of coils along the margins of the mattress innerspring.

10. Apparatus according to claim 9 wherein the clip wrapping tools are arranged in pairs in spaced, opposed relation adjacent to the support means.

11. Apparatus according to claim 10 wherein each pair of clip wrapping tools is supported on a frame in clip wrapping relationship to the borderwires and the mattress innerspring on the support means.

12. Apparatus according to claim 11 wherein a plurality of clip supply rolls formed of interconnected clips are supported on the frame for supplying clips to the clip wrapping tools.

13. Apparatus according to claim 12 wherein the clip supply rolls are each provided with a clip guide track extending between each roll and its associated clip wrapping tool.

14. Apparatus according to claim 1 wherein sensing means is provided for sensing the presence of a workpiece on the support means and for transmitting a signal in response thereto to said control means for actuating the clip wrapping means.

15. Apparatus according to claim 1 wherein the control means includes a counter for controlling the number of clips wrapped along each margin of the mattress innerspring.

16. Apparatus according to claim 1 wherein the support means is provided with side walls for maintaining the borderwires and the mattress innerspring in proper aligned relation on the support means.

17. Apparatus according to claim 1 wherein said support means includes conveyor sections supported on a frame.

18. Apparatus according to claim 1 wherein auxiliary support means is provided for said support means for receiving the structure formed at said support means by securing clips to the borderwires and the coils of the mattress innerspring, said structure being characterized in that portions of the borderwires remain unsecured to coils of the mattress innerspring.

19. Apparatus according to claim 18 wherein clip wrapping means is positioned adjacent to the auxiliary support means for wrapping clips on the unsecured portions of the borderwires and coils of the mattress innerspring extending therealong.

20. Apparatus according to claim 18 wherein the clip wrapping means includes a plurality of spaced pairs of clip wrapping tools positioned in opposed relation on opposite sides of the auxiliary support means.

21. Apparatus according to claim 18 wherein coil engaging means is provided for the auxiliary support means for positioning the unsecured coils of a mattress innerspring in proper alignment with the borderwires when the clip wrapping tools are activated.

22. Apparatus according to claim 18 wherein pusher means is provided for the auxiliary support means for advancing the unsecured portions of the borderwires and said coils of the mattress innerspring therealong.

23. A method of securing borderwires on the coils of a mattress innerspring, comprising: providing support means for receiving borderwires and a mattress innerspring on the support means in a manner to position the mattress innerspring between the borderwires; advancing the stacked borderwires and mattress innerspring along the support means to a clip wrapping station positioned adjacent to the support means; interrupting the advance of the borderwires and the mattress innerspring at the clip wrapping station; simultaneously wrapping a plurality of clips on the borderwires and the coils of the mattress innerspring at the clip wrappping station; and continuing the advance of the borderwires and the mattress innerspring along the support means and the interrruption thereof at the clip wrapping station until the borderwires are secured to the coils of the mattress innerspring.

24. A method according to claim 23, wherein at least two clips are simultaneously wrapped on each side of the borderwires and the mattress innerspring at the clip wrapping station.

25. A method according to claim 23 wherein the advance of the borderwires and the mattress innerspring along the support means and interruption thereof at the clip wrappping station are automatically controlled by a signal transmitted by sensing means positioned in signal transmitting relationship to the path of travel of the borderwires and the mattress innerspring along the support means.

26. A method according to claim 23 wherein the borderwires are maintained in spaced apart relation to the coils of the mattress innerspring at a point adjacent to the clip wrapping station.

27. A method according to claim 23 wherein two sides only of the borderwires are secured to the coils along the corresponding margins of the mattress innerspring.

28. A method according to claim 27 wherein the mattress innerspring with two sides of the borderwires secured thereto is transferred to auxiliary support means provided with a clip wrapping station for wrapping clips on the unsecured sides of the borderwires and the coils of the mattress innerspring positioned therealong.

29. A method according to claim 23 wherein at least one clip is initially wrapped on the borderwires and the mattress innerspring to establish the alignment of the borderwires with the mattress innerspring.

30. A method according to claim 29 wherein said at least one clip is automatically wrapped on the borderwires and the mattress innerspring at the clip wrapping station.

* * * * *